US009926710B2

(12) United States Patent
Moore

(10) Patent No.: US 9,926,710 B2
(45) Date of Patent: Mar. 27, 2018

(54) SCAFFOLD TRAY

(76) Inventor: Philip Moore, Hove (GB)

( * ) Notice: Subject to any disclaimer, the term of this patent is extended or adjusted under 35 U.S.C. 154(b) by 598 days.

(21) Appl. No.: 13/320,344

(22) PCT Filed: Nov. 30, 2010

(86) PCT No.: PCT/GB2010/051993

§ 371 (c)(1),
(2), (4) Date: Nov. 14, 2011

(87) PCT Pub. No.: WO2011/064604

PCT Pub. Date: Jun. 3, 2011

(65) Prior Publication Data

US 2012/0055839 A1 Mar. 8, 2012

(30) Foreign Application Priority Data

Nov. 30, 2009 (GB) ..... 0920912.3

(51) Int. Cl.

| | |
|---|---|
| ***B65D 1/34*** | (2006.01) |
| ***E04G 5/00*** | (2006.01) |
| ***E04G 7/28*** | (2006.01) |

(52) U.S. Cl.

CPC ..... *E04G 5/00* (2013.01); *E04G 5/003* (2013.01); *E04G 7/28* (2013.01); *B65D 1/34* (2013.01)

(58) Field of Classification Search

CPC ..... B65D 1/34; B65D 81/3813; E04G 7/28; E04G 5/00; E04G 5/003; E04G 5/004

USPC ..... 220/475, 720, 737, 557, 751, 755; 248/218.4, 219.1, 219.2, 219.3, 219.4; 182/222, 223, 119; 206/557

See application file for complete search history.

(56) References Cited

U.S. PATENT DOCUMENTS

| | | | | |
|---|---|---|---|---|
| 3,241,633 | A | 3/1966 | Bond | |
| 3,889,805 | A * | 6/1975 | Korten | 206/747 |
| 3,904,041 | A | 9/1975 | Medgebow | |
| 5,121,812 | A * | 6/1992 | Ochiai et al. | 182/222 |
| 5,265,729 | A * | 11/1993 | Carlin | 206/561 |
| 5,934,499 | A * | 8/1999 | van der Hoven | 220/475 |
| 6,206,258 | B1 * | 3/2001 | Calder | 224/420 |
| 6,357,616 | B1 * | 3/2002 | Harris et al. | 220/475 |
| 8,020,819 | B2 * | 9/2011 | Crow et al. | 248/219.4 |
| 2006/0169537 | A1 | 8/2006 | Enochs | |

(Continued)

FOREIGN PATENT DOCUMENTS

| | | |
|---|---|---|
| DE | 2144036 | 3/1973 |
| DE | 4135888 | 5/1993 |

(Continued)

OTHER PUBLICATIONS

International Search Report for corresponding patent application No. PCT/GB2010/051993 filed Feb. 7, 2011.

(Continued)

*Primary Examiner* — Andrew Perreault
(74) *Attorney, Agent, or Firm* — Quine IP Law

(57) ABSTRACT

The present invention discloses a lipped tray, intended for use on scaffold towers and adapted to hold builders' tools in use. The tray incorporates on each of its two opposite side edge regions a means which, when the tray is in use, locates the tray between horizontally successive rails of the tower in a manner which also causes the tray to engage with one at least of those rails and be supported, in use, by each of them.

7 Claims, 2 Drawing Sheets

(56) References Cited

U.S. PATENT DOCUMENTS

| | | | | |
|---|---|---|---|---|
| 2008/0000722 | A1 | 1/2008 | Winslow | |
| 2008/0223736 | A1* | 9/2008 | Nespoli | 206/557 |
| 2008/0272125 | A1 | 11/2008 | Crow | |

FOREIGN PATENT DOCUMENTS

| | | | |
|---|---|---|---|
| GB | 2215376 | | 9/1989 |
| GB | 2325487 | A | 11/1998 |
| GB | 2438469 | | 5/2006 |
| WO | 99/09289 | | 2/1999 |

OTHER PUBLICATIONS

Intellectual Property Office Combined Search and Examination Report dated Feb. 7, 2011 for corresponding GB 0920912.3.
Intellectual Property Office Combined Search and Examination Report dated Nov. 30, 2011 for corresponding GB 0920912.3.

* cited by examiner

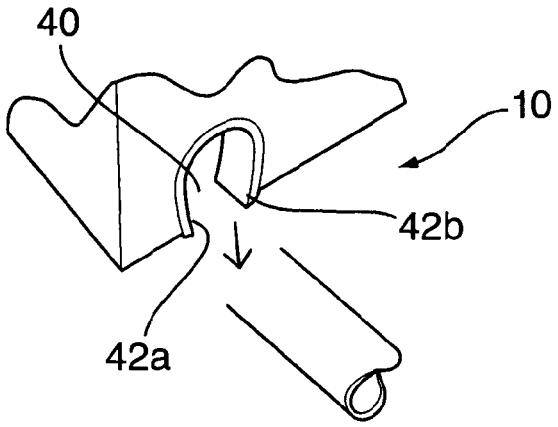
Fig.2
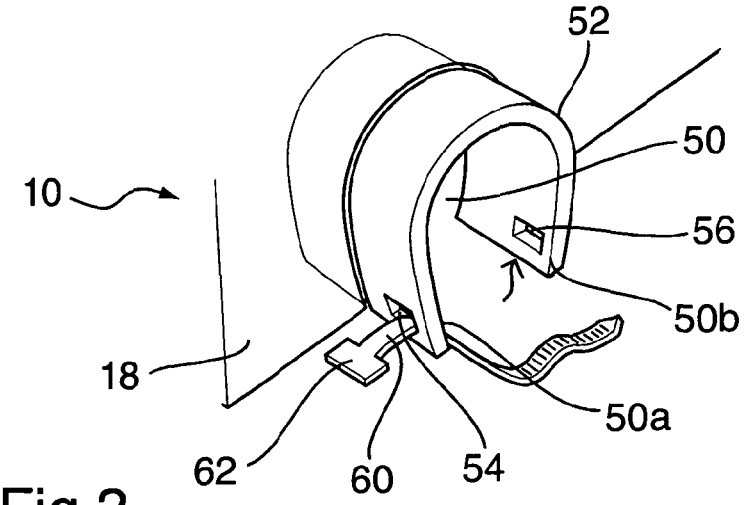
Fig.3
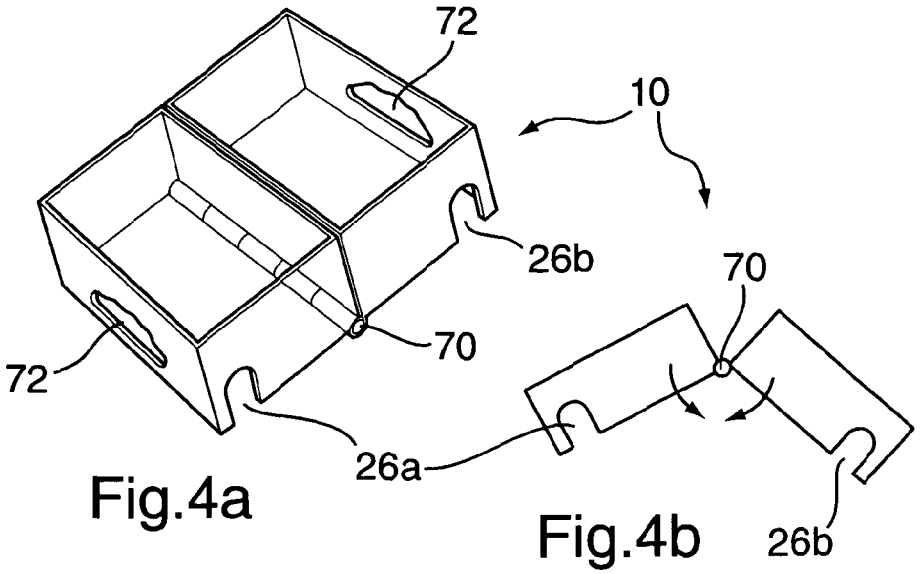
Fig.4a
Fig.4b

SCAFFOLD TRAY

This application is a national phase of International Application No. PCT/GB2010/051993 filed 30 Nov. 2010 and published in the English language.

FIELD OF THE INVENTION

This invention relates to a scaffold tray adapted for holding tools and for use on a scaffold tower.

BACKGROUND TO THE INVENTION

When tradesmen work on scaffolding towers, they require a safe and secure surface on which to place their tools and materials. If a tool falls from a scaffold tower, it can cause a large amount of damage to an object or a person below. Therefore, tools need to be safely positioned while not in use, but also need to be readily available to the tradesman. Furthermore, when the tradesman has completed their work, the tray until needs to be removed from the scaffold tower before the scaffold tower is disassembled.

Known to the applicant are the following published patent specifications;

U.S. Pat. No. 3,020,972 A (Hockett)

U.S. Pat. No. 4,979,710 A (Baldwin)

These two documents relate to trays that fit onto conventional ladders. Both devices rely upon two hooks engaging a horizontal bar of the ladder, and the tray portion being maintained in a substantially horizontal position by way of a leg of the tray extending perpendicularly to the horizontal bar and extending in a generally vertical direction. Neither of the trays disclosed in these documents are suitable for use on scaffolding.

At present whilst scaffolding towers must include kick boards at low level (foot level) on the working platform, there is no similar protection at working height.

Also known are:

CN 1572994 A (Gibson et al)

U.S. Pat. No. 3,904,041 (Medgebow)

U.S. Pat. No. 4,357,881 (De Long)

Gibson discloses a domestic scaffold unit having a utility tray attached to it. The tray pivots about a substantially horizontal rung and is supported from the underside by support links. The tray is intended to remain fixed onto the unit although it can be replaced should it become damaged.

Medgebow discloses a tray attachment for a lipped commercial kitchen table, the tray comprising two adjacent hooked portions along one of its sides that hook onto the lipped edge of the table. The tray rests against the side of the table and provides a shelf for supporting various kitchen utensils. The tray is easily disengaged from the table by lifting the edge furthest from the lipped table. The tray can slide horizontally along the side of the table.

De Long discloses a hospital bed tray comprising a flat tray and a supporting arm. One edge of the tray rests on top of a bed railing of the bed, whilst the opposite edge is connected on the underside of the tray to the supporting arm. The supporting arm is permanently attached to the bed railings and the tray collapses by folding the supporting arm and allowing the tray portion to be positioned vertically parallel to the railings.

None of the three disclosures are intended for use on scaffolding towers and would not be suitable for such use.

Further known to the applicant are:

GB 2438496 (Atkins)

GB2325487 (Nolan et al)

Nolan discloses a receptacle having a curved lip at the top to engage a scaffolding pole. The receptacle hangs vertically down from a first horizontal scaffolding pole and is able to slide horizontally along the said first pole. The receptacle extends in a downward direction and is supported by a second horizontal scaffold pole positioned parallel to and beneath the first. The second scaffold pole restricts movement of the receptacle if the wind blows at the receptacle from the tool-holding direction, however, wind blowing at the reverse of the receptacle may swing the receptacle, making it unstable. The receptacle replies upon the distance between the scaffolding poles for stability and the wind blowing in the correct direction in order to hold the tools in a stable position. On standard scaffold towers, this will result in a very deep receptacle, making it difficult and potentially dangerous for a tradesman to retrieve their tools quickly.

Atkins discloses a receptacle of a similar construction to Atkins. The receptacle comprises a curved lip at the top which engages a horizontal scaffolding pole. The receptacle in Atkins comprises a curved arm at one edge for engaging a vertical scaffold pole in order to stabilise the receptacle. This allows the device to be shallower than that disclosed in Nolan, making it easier for the tradesman to access tools placed in the receptacle. However, the receptacle is still vulnerable to strong winds approaching from the back of the device. Furthermore, the device requires the use of a vertical scaffold pole in order to be at its most stable, thereby limiting the locations in which it might be positioned.

None of these documents provide a fully satisfactory solution to the problems outlined above.

The invention takes these known documents as its starting point.

SUMMARY OF THE INVENTION

Accordingly, the present invention provides a lipped tray, intended for use on scaffold towers and adapted to hold builders' tools in use, and characterised by the feature that it incorporates on each of its two opposite side edge regions a means which, when the tray is in use, locates the tray between horizontally successive rails of the tower in a manner which also causes the tray to engage with one at least of those rails and be supported, in use, by each of them.

Preferably, the means for engagement comprises one or more recessed regions in the underside of the tray.

When the tray is in use, it will generally be positioned at a substantial height above ground level. It is therefore advantageous if the tray has means to resist any inadvertent disengagement, in use, of the tray from the, or each, pole. Such means reduce the likelihood of the wind disengaging the tray, or a person from knocking the tray and it disengaging.

It is preferable that the recessed region—or at least one such recessed region if there are more than one—is a push-fit onto the pole. It is advantageous if the recessed region—or at least one such region if there are more than one—incorporates a yieldable material which, in use, will facilitate the necessary push-fit of the tray onto the pole. Using a push-fit mechanism that is built into the design of the tray reduces the costs associated with producing a tray with means to resist inadvertent disengagement. Furthermore, the use of a yieldable material reduces the number of movable parts that are vulnerable to wear and fracture.

In a preferred embodiment, the tray incorporates means to lock the underside of the tray, in use, to the pole. Such a locking means further reduces the likelihood of unintentional disengagement.

It is advantageous if the locking action is provided by a pull-through strap, and preferably the strap is of a one-way-only kind. More preferably, the one-way-only strap comprises a plastics toothed cable tie of generally known kind. Such straps are easy to use and cheap to replace.

In one embodiment the tray folds, when not in use, for carrying. It is advantageous if the tray folds about its base. Preferably, the tray is provided with cut-outs or indentations in each of its lipped regions which face one another across the fold line of the tray so that, when the tray folds for carrying, the cut-outs or the indentations coincide to form a carrying handle. Such a carrying handle makes the tray easy to carry up scaffolding towers and also allow one to carry the tray in one hand. By folding about the base, the tray is solid when in use, but can be easily folded when not.

Preferably, the tray is configured so as to stack, when not in use, with identical such trays. This allows for convenient storage of multiple trays.

BRIEF DESCRIPTION OF THE DRAWINGS

An embodiment of the invention will now be described, by way of example only, and with reference to the accompanying drawings, in which:

FIG. 2 is a partial perspective view of a second embodiment of a tray according to the present invention;

FIG. 3 is a partial perspective view of a third embodiment of a tray according to the present invention; and FIGS. 4*a* and 4*b* are views of a fourth embodiment of a tray according to the present invention.

DETAILED DESCRIPTION OF EXEMPLARY EMBODIMENTS

Figure 1:
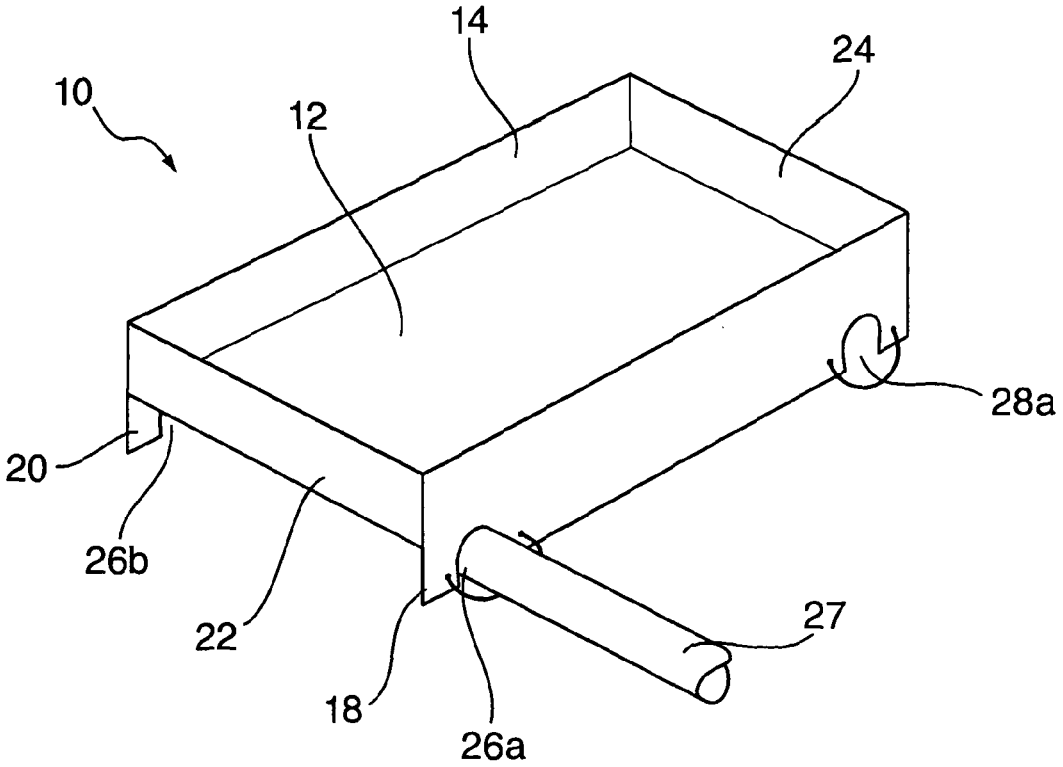
FIG. 1 is a diagram showing a perspective view of a scaffold tray according to the present invention.

FIG. 1 shows a lipped tray 10, for use on scaffolding towers, comprising a base portion 12, having a generally rectangular profile. An upwardly extending lip 14 is provided around the perimeter of the base portion 12. Along the long sides of the base portion 12 are downwardly extending skirt portions 18 and 20.

In the region adjacent to each of the smaller sides 22 and 24 of the base portion 12, a first recessed arc 26*a* is cut at one end of the skirt portion 18, and a corresponding recessed arc 26*b* is cut into the skirt portion 20 in a position substantially the same distance from the end of the base 12. The diameter of the recessed arcs 26*a* and 26*b* is sufficient to receive a scaffolding pole 27. Corresponding arcs 28*a* and 28*b* (not shown) are provided adjacent to the side 24 of the base from 26*a* and 26*b* in the skirt portions 18 and 20.

When in use, the tray 10 is positioned to engage two substantially horizontally successive scaffolding poles, within the arcs 26*a*, 26*b*, 28*a* and 28*b*. The tray is thus held between the scaffolding poles, creating a substantially horizontal lipped surface for holding tradesman's tools.

FIG. 2 shows a recessed arc 40 with a diameter greater than the diameter of the scaffolding pole that it is to engage, constructed from a yieldable plastics material. The distance between the two edges 42*a* and 42*b* at the opening 42 to the arc 40 has a distance between them of less than that of the diameter of the scaffolding pole to which is it to engage. The tray 10 engages the scaffolding pole by flexing until the opening to the arc 42 is sufficiently wide enough to allow the pole to be received within the arc 40. The plastics material then returns to its original shape to engage the pole and reduce the likelihood of the tray 10 disengaging.

FIG. 3 shows a tray 10 having a recessed arc 50 similar to that shown in FIG. 1, however, the arc 50 comprises a collar 52 having the same shape as the arc 50 and extending perpendicularly from the skirt portion 18. The collar 52 comprises a first aperture 54 passing through the collar 52 at one side of the arc opening 50*a*, and a second aperture 56 at the other side of the arc opening 50*b*. The second aperture 56 comprises a tooth (not shown) which extends partially into the aperture.

When the tray 10 is engaged with the scaffold pole, a first end of a nylon tape comprising an integrated one-way gear rack 60 is fed through the first aperture 54, and passes through the second aperture 56. The tooth of aperture 56 engages the one-way gear rack and as the tape 60 passes through the aperture 56, and reverse movement is restricted by the tooth. The nylon tape 60 comprises a stop mechanism 62 at the other end to the first, to prevent the tape 60 from passing through both apertures. As the tape 60 passes through the apertures, the stop mechanism is pulled adjacent to the collar 52 and the tape 60 is held tightly between the arc opening 50*a* and 50*b*. Therefore, the tape 60 tightens reduces the likelihood of the tray 10 disengaging the scaffolding pole. When it is necessary for the user to disengage the tray 10 from the scaffold pole, the nylon tape 60 is cut at a position between the two apertures 54 and 56. The nylon tape 60 may a cable tie.

FIGS. 4*a* and 4*b* show a tray 10 having recessed arcs 26*a*, 26*b*, 28*a* and 28*b* in the skirt portions 18 and 20, as in FIG. 1. The tray of FIGS. 4*a* and 4*b* comprises a hinge mechanism 70 substantially equidistant from each end of the base 10, and cut-out portion 72 in the lip wall portion of each short side of the tray 10. The hinge mechanism 70 allows for the tray 10 to be substantially folded in half. When the tray 10 has been folded, the cut-out portions 72 coincide to give a convenient position for the user to grip.

Alternatively, a hinge could be mounted on the top edge, and this arrangement could also include a locking mechanism to prevent it from collapsing whilst allowing the tray halves to fold to allow it to operate as a tool case.

The tray 10, may be injection moulded or vacuum moulded.

Variations and modifications to the illustrated construction may occur to the reader familiar with the art without taking the device outside the scope of the present invention. For example, providing the tray with other types of locking mechanism to reduce the likelihood of disengaging the scaffold pole.

The tray made be coloured according to the end user. For example, blue for plumbers, red for fire engineers and yellow for electricians. As well as tools, the tray could be adapted to carry materials and/or fittings for the intended task.

The tray removes the risk of trip hazard whilst working at height on the scaffold platform arising from the operative placing tools and materials on the platform.

The location method of the tray allows the operative to slide the tray to the required workface, negating the requirement to move the tower and/or moving around the tower. The other patent applications referenced—even where similar—are restricted by way of the location/fixing points.

The invention claimed is:

1. A tray comprising:

a base with four edges;

four sides comprising bottom edges and mounted peripherally around the base with lips extending up from each of the base edges, herein the four sides comprise two opposing sides;

wherein the two opposing sides have bottom edges and wherein the bottom edges of the each of the two opposing sides comprise two recesses; and, wherein the tray is adapted to receive and be supported by a pair of poles each in separate pairs of the recesses.

2. The tray of claim 1, wherein the two opposing sides extend downwardly from the base forming opposing skirts, and wherein the recesses are in the skirts.

3. The tray of claim 1, wherein the recesses are adapted to receive the poles with a push-fit.

4. The tray of claim 1, further comprising a hinge mounted equidistant between opposing sides not comprising the recesses.

5. The tray of claim 4, further comprising cut outs forming hand grips in each of the opposing sides not comprising the recesses, and adapted so that when folded on the hinge the cutouts come adjacent to each other to form a carrying handle.

6. The tray of claim 1, further comprising cut outs forming hand grips in each of the opposing sides not comprising the recesses.

7. The tray of claim 1, further comprising a means of locking the poles in the recesses.

* * * * *